US005461464A

United States Patent [19]

Swain

[11] Patent Number: 5,461,464

[45] Date of Patent: Oct. 24, 1995

[54] PHOTORECEPTOR ASSEMBLY

[75] Inventor: Eugene A. Swain, Webster, N.Y.

[73] Assignee: Xerox Corporation, Stamford, Conn.

[21] Appl. No.: 333,690

[22] Filed: Nov. 3, 1994

[51] Int. Cl.[6] ..... G03G 21/00

[52] U.S. Cl. ..... 355/211; 355/200; 492/45; 492/47

[58] Field of Search ..... 355/200, 210, 355/133, 211; 492/18, 45, 47

[56] References Cited

U.S. PATENT DOCUMENTS

| | | | |
|---|---|---|---|
| 4,040,157 | 8/1977 | Shanly . | |
| 5,052,090 | 10/1991 | Kitaura et al. | 29/123 |
| 5,151,737 | 9/1992 | Johnson et al. | 355/211 |
| 5,323,211 | 6/1994 | Fujii et al. | 355/200 |
| 5,371,576 | 12/1994 | Gonda | 355/211 |

FOREIGN PATENT DOCUMENTS

| | | | |
|---|---|---|---|
| 0205882 | 8/1990 | Japan | 355/211 |

*Primary Examiner*—R. L. Moses
*Attorney, Agent, or Firm*—Zosan S. Soong

[57] ABSTRACT

There is disclosed a photoreceptor assembly comprising: (a) a substrate coated with layered material including a photoconductive material, wherein imaginary lines define the substrate into a center section disposed between a first end section and a second end section, and wherein the first end section defines an end edge and a surface hole; and (b) a flange member engaged with the first end section of the substrate, wherein the flange member is comprised of a projection which fits into the surface hole of the first end section, and wherein there is absent any adhesive between the engaging surfaces of the substrate and the flange member.

13 Claims, 3 Drawing Sheets

PHOTORECEPTOR ASSEMBLY

This invention relates generally to a photoreceptor assembly which may be part of an electrostatographic printing or copying apparatus. More specifically, the invention pertains to a photoreceptor assembly which is easy to disassemble since there is no adhesive employed to engage the end flanges to the photoreceptor.

Conventionally, end flanges are glued to cylindrical photoreceptors which complicate their dissassembly. It would be advantageous to provide a photoreceptor assembly that is easy to disassemble to facilitate recycling of the components which reduces costs and protects the environment.

Conventional photoreceptor assemblies are illustrated in Kitaura et al., U.S. Pat. No. 5,052,090, and Fujii et al., U.S. Pat. No. 5,323,211, the disclosures of which are totally incorporated by reference.

SUMMARY OF THE INVENTION

It is an object of the present invention to provide a photoreceptor assembly that is easy to disassemble to facilitate recycling of the components such as the end flanges and the photoreceptor cylinder.

These objects and others are accomplished in embodiments by providing a photoreceptor assembly comprising:

(a) a substrate coated with layered material including a photoconductive material, wherein imaginary lines define the substrate into a center section disposed between a first end section and a second end section, and wherein the first end section defines an end edge and a surface hole; and (b) a flange member engaged with the first end section of the substrate, wherein the flange member is comprised of a projection which fits into the surface hole of the first end section, and wherein there is absent any adhesive between the engaging surfaces of the substrate and the flange member.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in the Figures refers to the same or similar feature.

DETAILED DESCRIPTION

Figure 1:
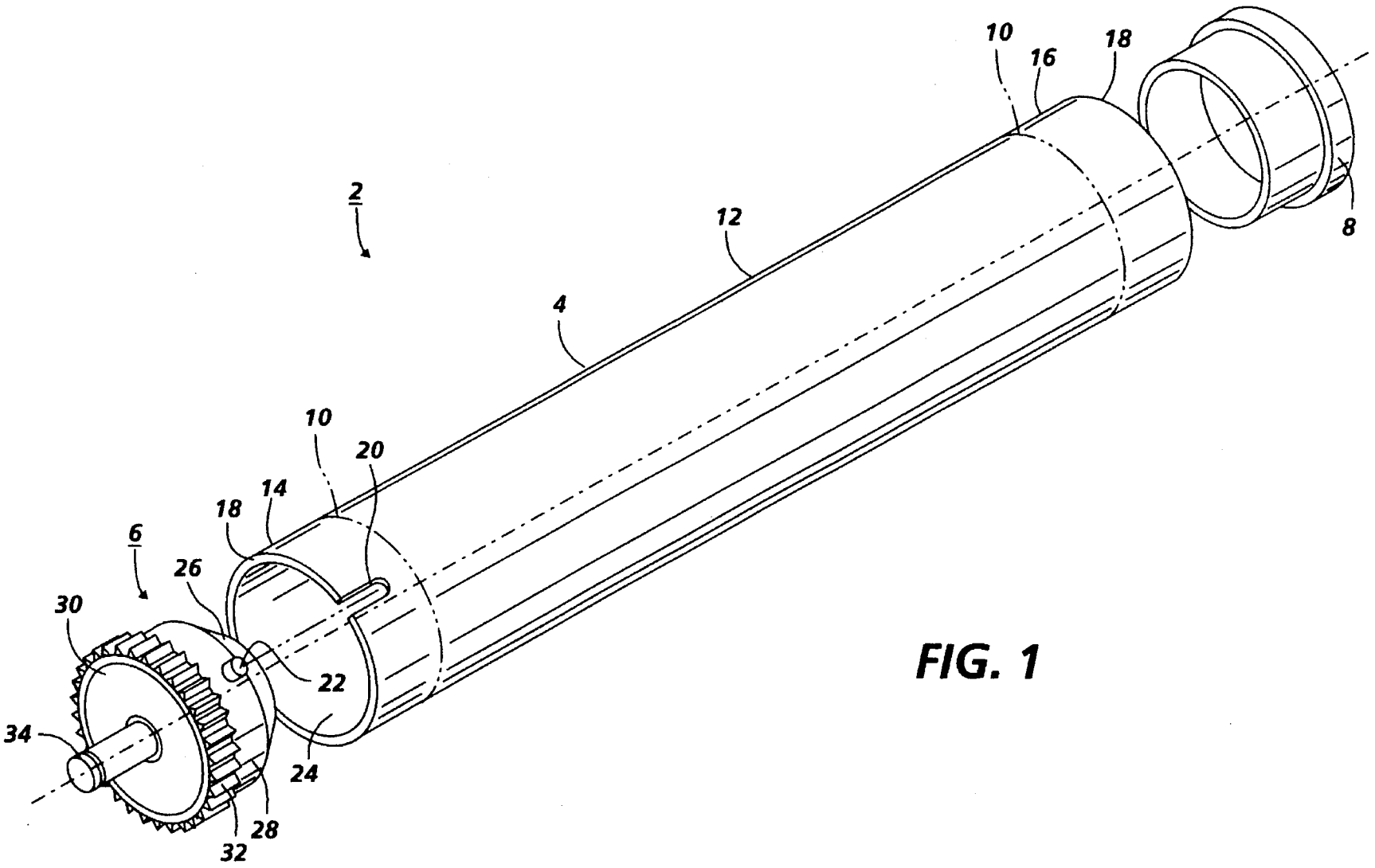
FIG. 1 represents a schematic, perspective view of the photoreceptor assembly.

In FIG. 1, photoreceptor assembly 2 is comprised of substrate 4 which may be in the form of a hollow cylinder, flange member 6, and optional second flange member 8. The imaginary lines 10 define the substrate 4 into a center section 12 disposed between a first end section 14 and a second end section 16. The precise dimensions of the first end section, the center section, and the second end section may vary in embodiments. In embodiments of the instant invention, each end section (14, 16) may have a length ranging for example from about 1 cm to about 8 cm, and preferably from about 1 cm to about 3 cm, as measured along the length of the substrate starting from the respective end edge 18. The first end section 14 may have the same or different length from the second end section 16. The first end section 14 defines a surface hole 20 which may extend through the wall of the substrate. As seen in FIG. 1, the surface hole 20 may be for instance a notch which extends from the end edge 18 into the first end section 14. The surface hole may be formed by machining, punching, or by employing a laser.

The substrate 4 can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to 10 centimeters, although the thickness can be outside of this range. When a flexible electrophotographic imaging member is desired, the substrate thickness typically is from about 0.015 mm to about 0.15 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®, wherein the metallized surface is in contact with the photosensitive layer or any other layer situated between the substrate and the photosensitive layer. The coated or uncoated substrate can be flexible or rigid, and can have any number of configurations, such as a cylindrical drum, an endless flexible belt, or the like. The outer surface of the substrate preferably comprises a metal oxide such as aluminum oxide, nickel oxide, titanium oxide, and the like.

The substrate may be of any dimension conventionally employed in photoreceptors. For example, in embodiments, hollow cylindrical substrates may have an inside diameter ranging from about 0.490 inch (12 mm) to about 30 inches, an outside diameter ranging from about 0.599 inch to about 30.5 inches, a length ranging from about 7 to about 44 inches, and a wall thickness ranging from about 0.001 to about 4 inches.

Figure 2:
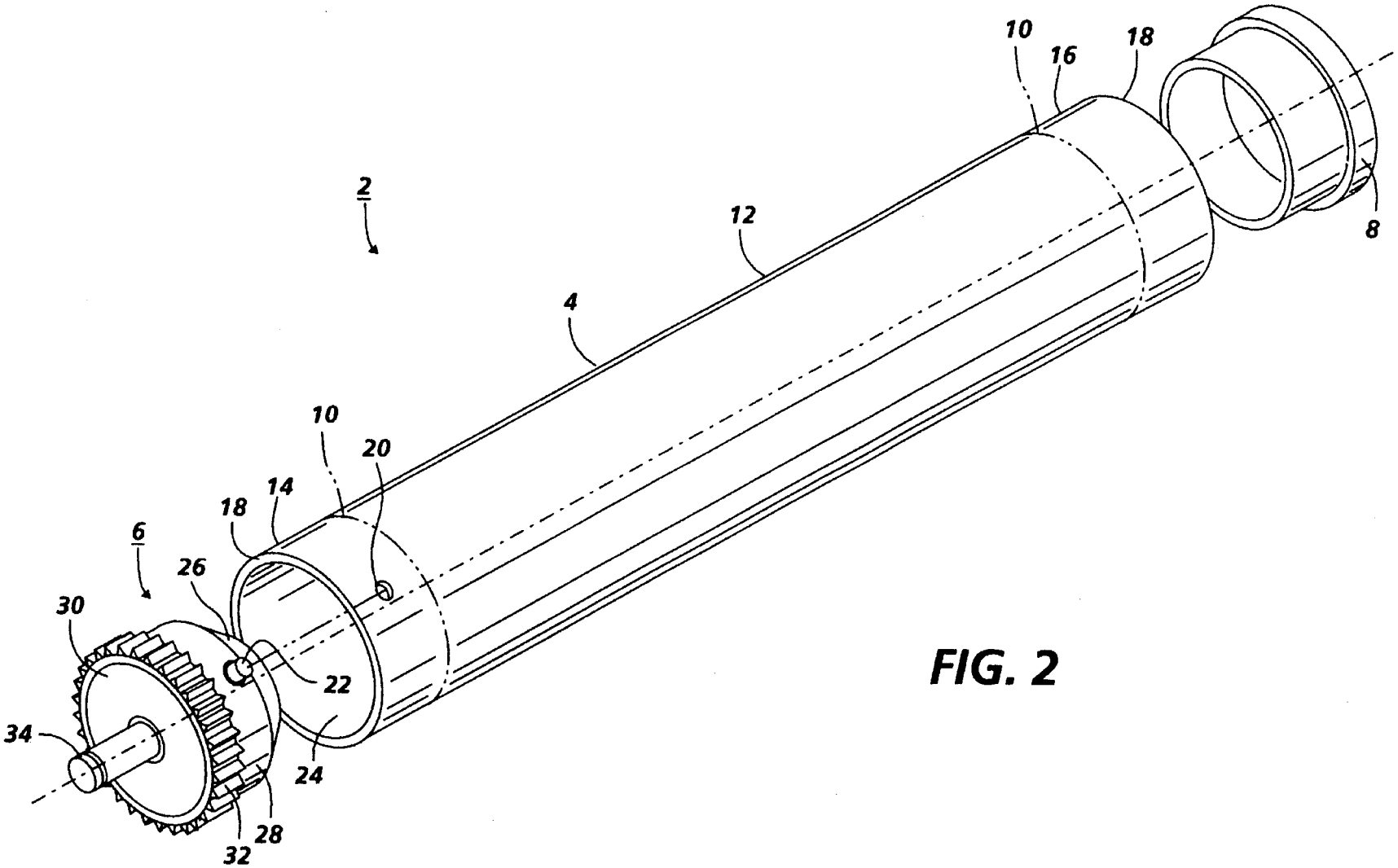
FIG. 2 represents a schematic, perspective view of another embodiment of the photoreceptor assembly.
Figure 3:
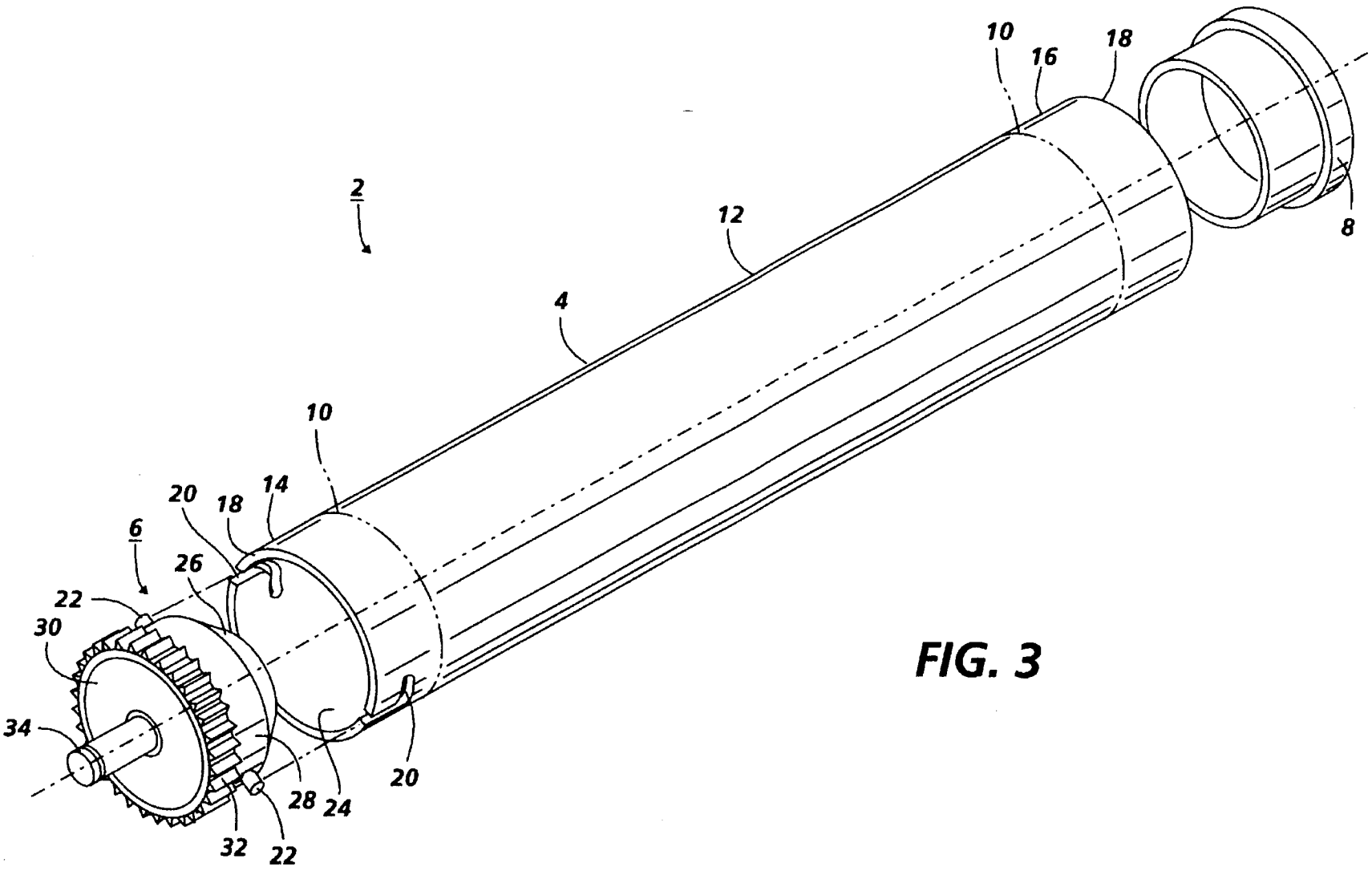
FIG. 3 represents a schematic, perspective view of still another embodiment of the photoreceptor assembly.

The substrate may be coated with a layered material (not shown in FIGS. 1–3). The layered material may comprise for example a photoconductive material and a charge transport material in the same layer or different layers. Illustrative photoreceptors, charge generating materials, charge transport materials, and photoreceptor fabrication techniques are disclosed in for example in U.S. Pat. Nos. 4,265,990; 4,390,611; 4,551,404; 4,588,667; 4,596,754; 4,797,337;

4,965,155; and 5,004,662, the disclosures of which are totally incorporated by reference.

The photoconductive material is capable in embodiments of generating electronic charge carriers in response to the absorption of radiation to be recorded by the imaging photoreceptor. The photoconductive material may be any suitable organic or inorganic photoconductor. Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds. Suitable inorganic photoconductive materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(-vinyltetraphene); poly(vinyltetracene) and poly(vinylperylene). Suitable electron transport materials include electron acceptors such as 2,4,7-trinitro-9-fluorenone; 2,4,5,7-tetranitrofluorenone; dinitroanthracene; dinitroacridene; tetracyanopyrene and dinitroanthraquinone.

The layered material (not shown) may also include one or more of the following layers that are typically found in a photoreceptor: a charge blocking layer, an adhesive layer, an anticurl layer, and an overcoat layer.

The flange member 6 includes a projection 22 which may be for example a pin or a boss. The flange member 6 is inserted into the end opening 24 defined by the first end section 14 so that the projection 22 fits into the surface hole 20. In embodiments, the projection may contact the rim of the surface hole and extend beyond the surface hole. The flange member may be held in position by a slight axial load on the flange member in the direction of the substrate imparted by for example a spring or other force applying mechanism. The projection functions to provide driving torque to the substrate such that rotation of the flange member also drives rotation of the substrate. In addition, the flange member functions in embodiments to provide longitudinal placement of the flange member, i.e., prevent the flange member from being inserted entirely into the end opening 24 of the substrate 4. The flange member 6 preferably comprises the following portions: an optional tapered portion 26 to facilitate insertion into the end opening 24; a middle portion 28 having an outer cross-sectional dimension which corresponds to the inner cross-sectional dimension of the substrate to provide a "slip fit"; and an outer portion 30 which has an outer cross-sectional dimension larger than the outer cross-sectional dimension of the substrate to provide longitudinal placement of the flange member, i.e., prevent the flange member from being inserted entirely into the end opening of the substrate. Gear teeth 32 may optionally be present on the outer portion of the flange member 6 to drive rotation of the flange member 6 and the substrate 4 or the gear teeth 32 can drive other components such as developer rolls, charging rolls, and the like. A drive shaft 34 may optionally be coupled to the flange member 6 to drive the rotation of the flange member and the substrate. The flange member may be fabricated by molding or machining from a plastic or metallic material.

The second flange member 8 may be for example an internal bushing which engages the second end section 16. In embodiments of the instant invention, the second flange member 8 and the second end section 16 have the same or similar configuration as the flange member 6 and the first end section 14 respectively.

Preferably, there is absent any adhesive between the engaging outer and inner surfaces of the substrate 4, the flange member 6, and the second flange member 8. By eliminating the use of adhesive, the instant invention facilitates disassembly of the photoreceptor assembly for recycling.

FIG. 2 illustrates another embodiment where the surface hole 20 is spaced from the end edge 18 at a distance ranging for example from about 5 mm to about 4 cm, and preferably from about 8 mm to about 2 cm (distance measured from the end edge 18 to the rim of the surface hole 20 along an imaginary line on the substrate surface parallel to the longitudinal axis of the substrate 4). The projection 22 may be for example spring-loaded to facilitate positioning of the projection into the surface hole.

FIG. 3 illustrates an alternate embodiment where the substrate 4 defines two surface holes 20 in the form of L-shaped slots in the first end section 14 adjacent the end edge 18. The two surface holes may be circumferentially equidistant from one another. The flange member 6 includes two projections 22 which may be in the form of pins. The two projections also may be circumferentially equidistant from one another. Since the surface holes are L-shaped slots, the flange member needs to be given a twist upon insertion to lock the projections into position in the surface holes.

As seen in FIGS. 1–3, there may be a sole hole engaging protuberance (i.e., the projection 22) on the outer surface of the flange member and a sole aperture (i.e., the surface hole 20) in the surface of the first end section 14. However, in embodiments of the present invention, there may be a plurality of projections such as two, three, four or more, and a plurality of surfaces holes such as two, three, four or more. The surface holes and projections may have any effective size and shape. For example, the projection or projections may be a pin or a boss and may have an oval, square, round, or rectangular shape.

Other modifications of the present invention may occur to those skilled in the art based upon a reading of the present disclosure and these modifications are intended to be included within the scope of the present invention.

I claim:

1. A photoreceptor assembly comprising:

(a) a substrate coated with layered material including a photoconductive material, wherein imaginary lines define the substrate into a center section disposed between a first end section and a second end section, and wherein the first end section defines an end edge and a surface hole; and (b) a flange member engaged with the first end section of the substrate, wherein the flange member is comprised of a projection which fits into the surface hole of the first end section, and wherein there is absent any adhesive between the engaging surfaces of the substrate and the flange member.

2. The assembly of claim 1, wherein the substrate is a cylinder.

3. The assembly of claim 1, wherein the surface hole is positioned at a distance from the end edge.

4. The assembly of claim 1, wherein the surface hole extends from the end edge into the first end section.

5. The assembly of claim 1, wherein the surface hole is in the form of a notch.

6. The assembly of claim 1, further comprising a drive shaft operatively associated with the flange member.

7. The assembly of claim 1, wherein the flange member defines gear teeth.

8. The assembly of claim 1, wherein the projection is in the form of a pin.

9. The assembly of claim 1, wherein the projection is spring-loaded.

10. The assembly of claim 1, further comprising a second flange member engaged with the second end section.

11. The assembly of claim 1, wherein the projection is the sole hole engaging protuberance on the outer surface of the flange member and the surface hole is the sole aperture in the surface of the first end section.

12. The assembly of claim 1, wherein the first end section defines a second surface hole and the flange member is comprised of a second projection which fits into the second surface hole.

13. The assembly of claim 12, wherein the first surface hole and the second surface hole are generally L-shaped.

* * * * *